US007387005B2

(12) United States Patent
Huang et al.

(10) Patent No.: US 7,387,005 B2
(45) Date of Patent: Jun. 17, 2008

(54) BATHROOM LOCK DEVICE HAVING AN AUTOMATICALLY UNLOCKING STRUCTURE

(75) Inventors: Lan-Shi Huang, Kaohsiung (TW); Chia-Chi Huang, Tzu-Kuan Hsiang (TW)

(73) Assignee: Taiwan Fu Hsing Industrial Co., Ltd., Kaohsiung Hsien (TW)

( * ) Notice: Subject to any disclaimer, the term of this patent is extended or adjusted under 35 U.S.C. 154(b) by 303 days.

(21) Appl. No.: 11/237,392

(22) Filed: Sep. 28, 2005

(65) Prior Publication Data

US 2007/0068209 A1 Mar. 29, 2007

(51) Int. Cl.
*E05B 55/04* (2006.01)

(52) U.S. Cl. ..... 70/467; 70/468; 70/472; 70/477; 292/336.3; 292/359

(58) Field of Classification Search ..... 70/467, 70/468, 470–472, 476–480; 292/336.3, 358, 292/359

See application file for complete search history.

(56) References Cited

U.S. PATENT DOCUMENTS 5,286,074 A 2/1994 Lin ..... 292/336.3
5,562,317 A 10/1996 Kuo et al. ..... 292/359
6,568,231 B1 5/2003 Huang ..... 70/468
6,644,077 B1 11/2003 Huang ..... 70/468
6,647,753 B2 * 11/2003 Engler ..... 70/472
2005/0046203 A1 3/2005 Huang ..... 292/348

OTHER PUBLICATIONS

Taiwanese Patent Publication No. 261178, Oct. 21, 1995, 4 pages.
Taiwanese Patent Publication No. M245255, Oct. 1, 2004, 8 pages.

* cited by examiner

*Primary Examiner*—Suzanne Dino Barrett
(74) *Attorney, Agent, or Firm*—Alan Kamrath; Kamrath & Associates PA

(57) ABSTRACT

A bathroom lock device includes an inner locking mechanism and a lock set. The inner locking mechanism includes a manual control rod, an unlocking rotary plate and an inner actuating rotary plate. The manual control rod has a rotatable wheel while the unlocking rotary plate has a pair of actuating protrusions. In a locking operation, the manual control rod is pressed to a locking position so as to limit a rotational movement of the inner actuating rotary plate. In an unlocking operation, the manual control rod is returned to an unlocking position by turning a lever so as to permit turning the inner actuating rotary plate. When the lever turns the unlocking rotary plate, the actuating protrusions of the unlocking rotary plate smoothly push the rotatable wheel of the manual control rod so as to return the manual control rod to the unlocking position.

20 Claims, 8 Drawing Sheets

BATHROOM LOCK DEVICE HAVING AN AUTOMATICALLY UNLOCKING STRUCTURE

BACKGROUND OF THE INVENTION

1. Field of the Invention

The present invention relates to a bathroom lock device having an automatically unlocking structure. Particularly, the present invention relates to the bathroom lock device having a pair of actuating protrusions of an unlocking rotary plate to engage with a rotatable wheel of a manual control rod for carrying out a smoothly unlocking operation. More particularly, the present invention relates to the bathroom lock device using the actuating protrusions of the unlocking rotary plate for creating a rotational movement of the rotatable wheel of the manual control rod in the unlocking operation.

2. Description of the Related Art

Referring now to FIG. 1, a conventional bathroom lock device having an automatically unlocking structure includes an actuating shaft 81, an inner rose escutcheon 82, an inner locking mechanism 83, an outer rose escutcheon 84 and an outer actuating rotary plate 85, as described in Taiwanese Patent Publication No. M245255, entitled "LOCK AND UNLOCK STRUCTURE OF A BATHROOM LOCK DEVICE", and U.S. Patent Publication No. 2005/0046203, entitled "BATHROOM LOCK DEVICE". The actuating shaft 81 extends through a lock set 86 and drives it so that a latch bolt 861 of the lock set 86 can be slid to retract into the lock set 86 by turning the actuating shaft 81. An inner lever 821 mechanically connects with a first side of the inner rose escutcheon 82 while the inner locking mechanism 83 mechanically connects with a second side of the inner rose escutcheon 82 which is opposite to the first side of the inner rose escutcheon 82. Furthermore, the inner locking mechanism 83 consists of a manual control rod 831, an unlocking rotary plate 832 and an inner actuating rotary plate 833 which are assembled to constitute a manually controllable mechanism. The unlocking rotary plate 832 is securely mounted to the inner lever 821, but the inner actuating rotary plate 833 does not securely connect with the inner lever 821 and permits freely turning the inner lever 821 within a predetermined angular movement to create a delayed action in unlocking operation. Meanwhile, the inner actuating rotary plate 833 securely connects with the actuating shaft 81 to form an assembled relationship.

An outer lever 841 mechanically connects with a first side of the outer rose escutcheon 84 while the outer actuating rotary plate 85 mechanically connects with a second side of the outer rose escutcheon 84 which is opposite to the first side of the outer rose escutcheon 84. Meanwhile, the outer actuating rotary plate 85 securely connects with the outer lever 841 to form an assembled relationship.

In locking operation, a limiting portion of the manual control rod 831 engages in a recession portion of the inner actuating rotary plate 833 when the manual control rod 831 is pressed to travel to a lock position. Accordingly, the actuating shaft 81, the outer actuating rotary plate 85 and the outer lever 841 cannot be turned such that the bathroom lock device is locked. Conversely, in unlocking operation, once the inner lever 821 is turned, the inner lever 821 actuates the unlocking rotary plate 832 and the inner actuating rotary plate 833 to rotate synchronously. Subsequently, first engaging portions "a" of the unlocking rotary plate 832 push second engaging portions "b" of the manual control rod 831 so that the manual control rod 831 is forced to return to an unlock position. Once the limiting portion of the manual control rod 831 disengages from the recession portion of the inner actuating rotary plate 833, the inner actuating rotary plate 833 can turn the actuating shaft 81 to operate the lock set 86 in the event for opening a bathroom door (not shown). Accordingly, the bathroom lock device is unlocked.

The inner lever 821 of the above-mentioned bathroom lock device can be turned to actuate the unlocking rotary plate 832 for returning the manual control rod 831 to an unlock position. The first engaging portions "a" of the unlocking rotary plate 832 and the second engaging portions "b" of the manual control rod 831 are engaged with and repeatedly wore each other. After long-term use, constant friction can distort both of the first engaging portions "a" of the unlocking rotary plate 832 and the second engaging portions "b" of the manual control rod 831. Disadvantageously, the unlocking rotary plate 832 cannot push the manual control rod 831 to return to a correct unlock position; namely, the limiting portion of the manual control rod 831 cannot completely disengage from the recession portion of the inner actuating rotary plate 833. In this circumstance, the bathroom lock device is jammed and cannot be automatically unlocked. This results m deterioration of the product quality and reduction of the useful life of the bathroom lock device.

Referring now to FIGS. 2 and 3, another conventional bathroom lock device having an automatically unlocking structure includes a lever 91, an rose escutcheon 92, an actuating rotary plate 93, a manual control shaft 94 and an unlocking rotary plate 95, as described in Taiwanese Patent Publication No. 261178, entitled "AUTOMATICALLY UNLOCKABLE LOCK (III)", and U.S. Pat. No. 5,562,317, entitled "INNER HANDLE ASSEMBLY OF CYLINDER LOCK". By referring to FIG. 2, the lever 91 includes a spindle member 911 connected thereto. The rose escutcheon 92 is mounted around the spindle member 911 of the lever 91 and includes an axial hole 921 and an operating aperture 922 each of which has a direction running along a longitudinal line. In assembling operation, the axial hole 921 of the rose escutcheon 92 permits extending the spindle member 911 of the lever 91, and the operating aperture 922 is arranged to juxtapose the axial hole 921 on a plane of the rose escutcheon 92. Correspondingly, the actuating rotary plate 93 includes an axle hole 931 which fittingly engages with the spindle member 911 of the lever 91. The manual control shaft 94 has a pushing portion 941 and a limiting portion 942. A distal end of the manual control shaft 94 extends outwardly through the operating aperture 922 of the rose escutcheon 92 and also beyond an outer surface of the rose escutcheon 92. In operation, the manual control shaft 94 can be shifted between a locking position and an unlocking position by axial movement. The limiting portion 942 securely connects with the pushing portion 941 to form the manual control shaft 94.

In locking operation, the limiting portion 942 of the manual control shaft 94 is engaged with a recessed portion of the actuating rotary plate 93 so that the actuating rotary plate 93 cannot be turned for opening a (bathroom) door (not shown). In the locking position, an axial movement of the limiting portion 942 of the manual control shaft 94 with respect to the actuating rotary plate 93 is unlimited such that the manual control shaft 94 can be shifted to an unlocking position. Meanwhile, the unlocking rotary plate 95 is engaged with the spindle member 911 of the lever 91 and mounted in an inner side of the rose escutcheon 92.

In unlocking operation, the spindle member 911 of the lever 91 can synchronously actuate the unlocking rotary plate 95 for a rotary movement. Once the lever 91 is turned to rotate the unlocking rotary plate 95, the unlocking rotary plate 95 can push the limiting portion 942 of the manual control shaft 94 to cause an axial movement toward the rose escutcheon 92 for the unlocking operation. Accordingly, the limiting portion 942 of the manual control shaft 94 can be disengaged from a recessed portion of the actuating rotary plate 93 so that the actuating rotary plate 93 can be turned for opening a (bathroom) door (not shown). The spindle member 911 of the lever 91 connects with the actuating rotary plate 93 for turning operation, but the actuating rotary plate 93 permits freely turning the spindle member 911 of the lever 91 within a certain extent of the angular movement to create a delayed action of the lock. Namely, the actuating rotary plate 93 does not fit and securely connect with the spindle member 911 of the lever 91. Such practice may, however, cause the axial movement of the manual control shaft 94 to an unlocking position in advance in the unlocking operation. Concretely, the spindle member 911 of the lever 91 can turn unlocking rotary plate 95 synchronously to move the manual control shaft 94 in advance for unlocking operation, and then the actuating rotary plate 93 after the delayed action of the lock.

The lever 91 of the above-mentioned cylinder lock can be turned to actuate the unlocking rotary plate 95 in advance for returning the limiting portion 942 of the manual control shaft 94 to an unlock position. After long-term use, constant friction can distort both of engaging portions of the unlocking rotary plate 95 and the manual control shaft 94. Disadvantageously, the unlocking rotary plate 95 cannot push the manual control shaft 94 to return to a correct unlock position; namely, the limiting portion of the manual control shaft 94 cannot completely disengage from the recession portion of the actuating rotary plate 93. In this circumstance, the bathroom lock device is jammed and cannot be automatically unlocked. This results in deterioration of the product quality and reduction of the useful life of the lock.

Hence, there is a need for improving the unlocking structure of the lock and alleviating undesired results so as to increase the product quality and the useful life of the lock.

The present invention intends to provide a bathroom lock device having a pair of actuating protrusions of an unlocking rotary plate to engage with a rotatable wheel of a manual control rod for carrying out smoothly an unlocking operation. Accordingly, an inner lever can smoothly actuate to return the manual control rod to an unlocking position by turning the unlocking rotary plate. In unlocking operation, the engagement of the actuating protrusions of the unlocking rotary plate with the rotatable wheel of the manual control rod can in such a way mitigates and overcomes the above problem. Accordingly, the engagement of the actuating protrusions of the unlocking rotary plate with the rotatable wheel of the manual control rod can alleviate a degree of operational abrasion between the unlocking rotary plate and the manual control rod such that the product quality and the useful life of the bathroom lock device is increased.

SUMMARY OF THE INVENTION

The primary objective of this invention is to provide a bathroom lock device having an automatically unlocking structure, wherein a manual control rod has a rotatable wheel while an unlocking rotary plate has a pair of actuating protrusions. In unlocking operation, the actuating protrusions can push the rotatable wheel to smoothly return the manual control rod to an unlocking position. Accordingly, the operational reliability for the unlocking operation of the bathroom lock device is increased.

The bathroom lock device in accordance with the present invention includes an inner locking mechanism and a lock set. The inner locking mechanism includes a manual control rod, an unlocking rotary plate and an inner actuating rotary plate which are assembled to constitute a manually controllable mechanism. The manual control rod has a rotatable wheel while the unlocking rotary plate correspondingly has a pair of actuating protrusions. In locking operation, the manual control rod is pressed to a locking position so as to limit a rotational movement of the inner actuating rotary plate. In unlocking operation, the manual control rod is returned to an unlocking position by turning a lever so as to permit turning the inner actuating rotary plate. When the lever turns the unlocking rotary plate, the actuating protrusions of the unlocking rotary plate can smoothly push the rotatable wheel of the manual control rod so as to return the manual control rod to the unlocking position. Once unlocked, a rotational movement of the inner actuating rotary plate can actuate the lock set for opening a bathroom door.

Further scope of the applicability of the present invention will become apparent from the detailed description given hereinafter. However, it should be understood that the detailed description and specific examples, while indicating preferred embodiments of the invention, are given by way of illustration only, since various modifications will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 4:
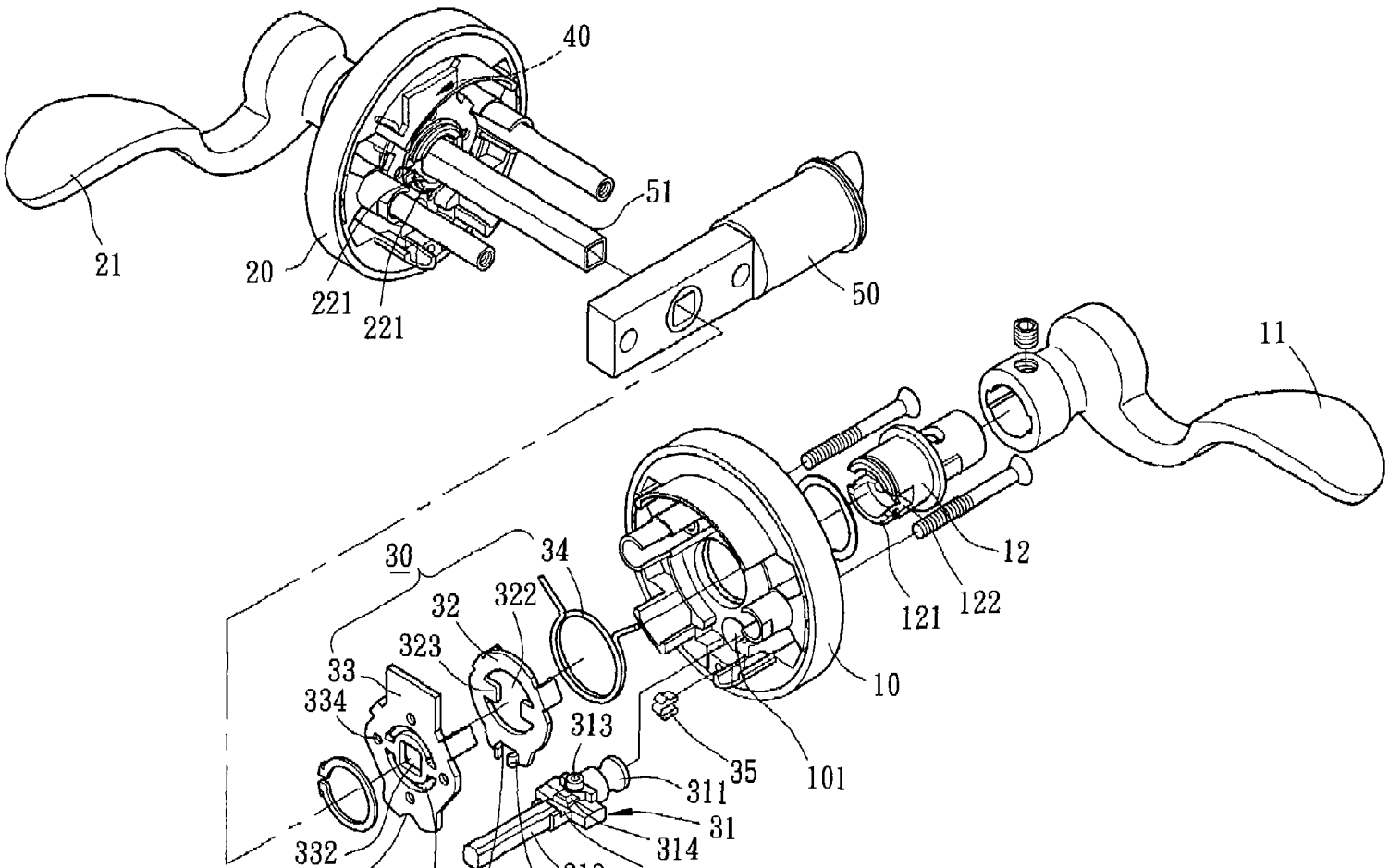
FIG. 4 is an exploded perspective view of a bathroom lock device having an automatically unlocking structure in accordance with a preferred embodiment of the present invention.
Figure 5:
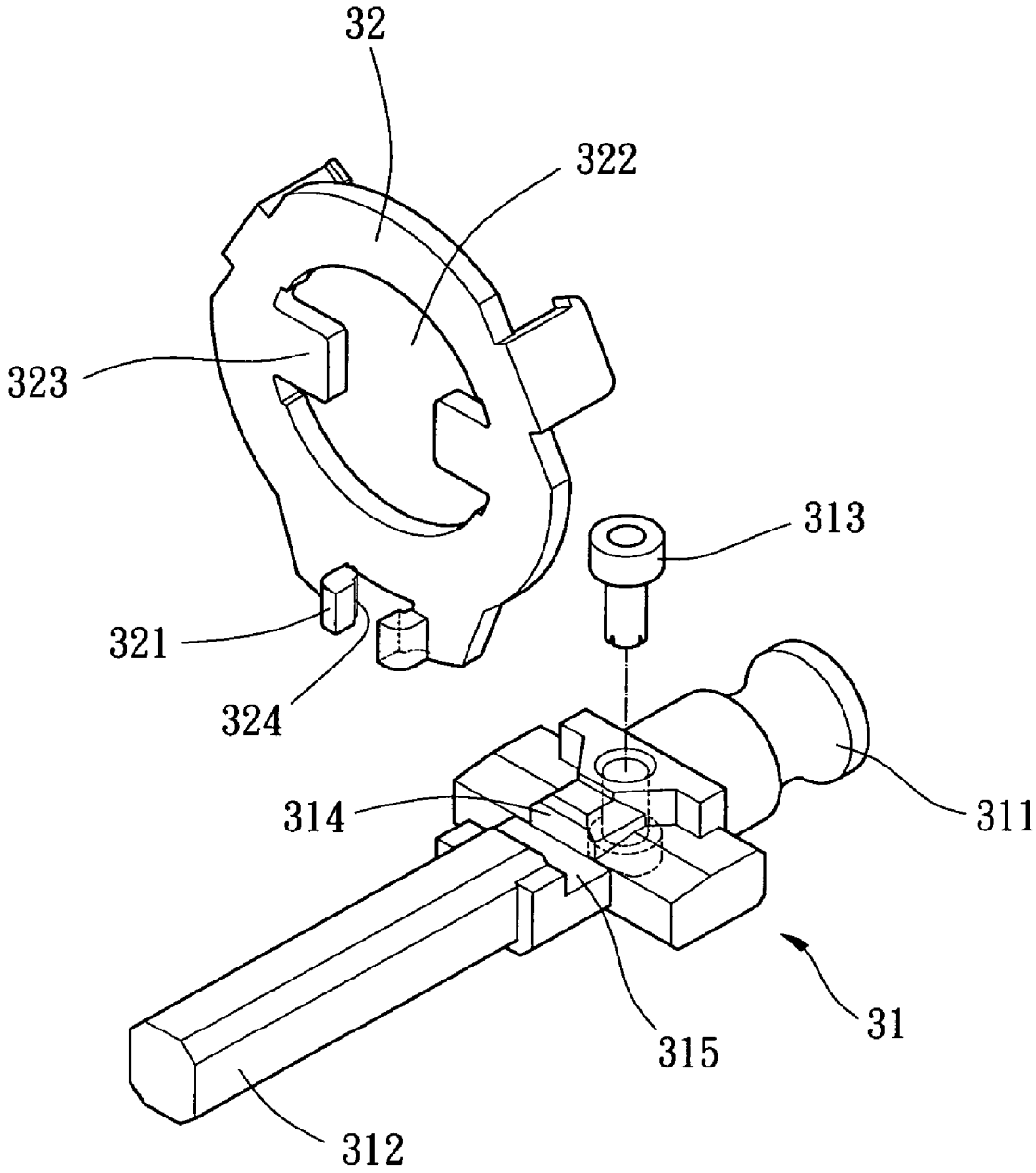
FIG. 5 is an enlarged, perspective view of a manual control rod and an unlocking rotary plate for use in the automatically unlocking structure of the bathroom lock device, as depicted in FIG. 4, in accordance with the preferred embodiment of the present invention.
Figure 6:
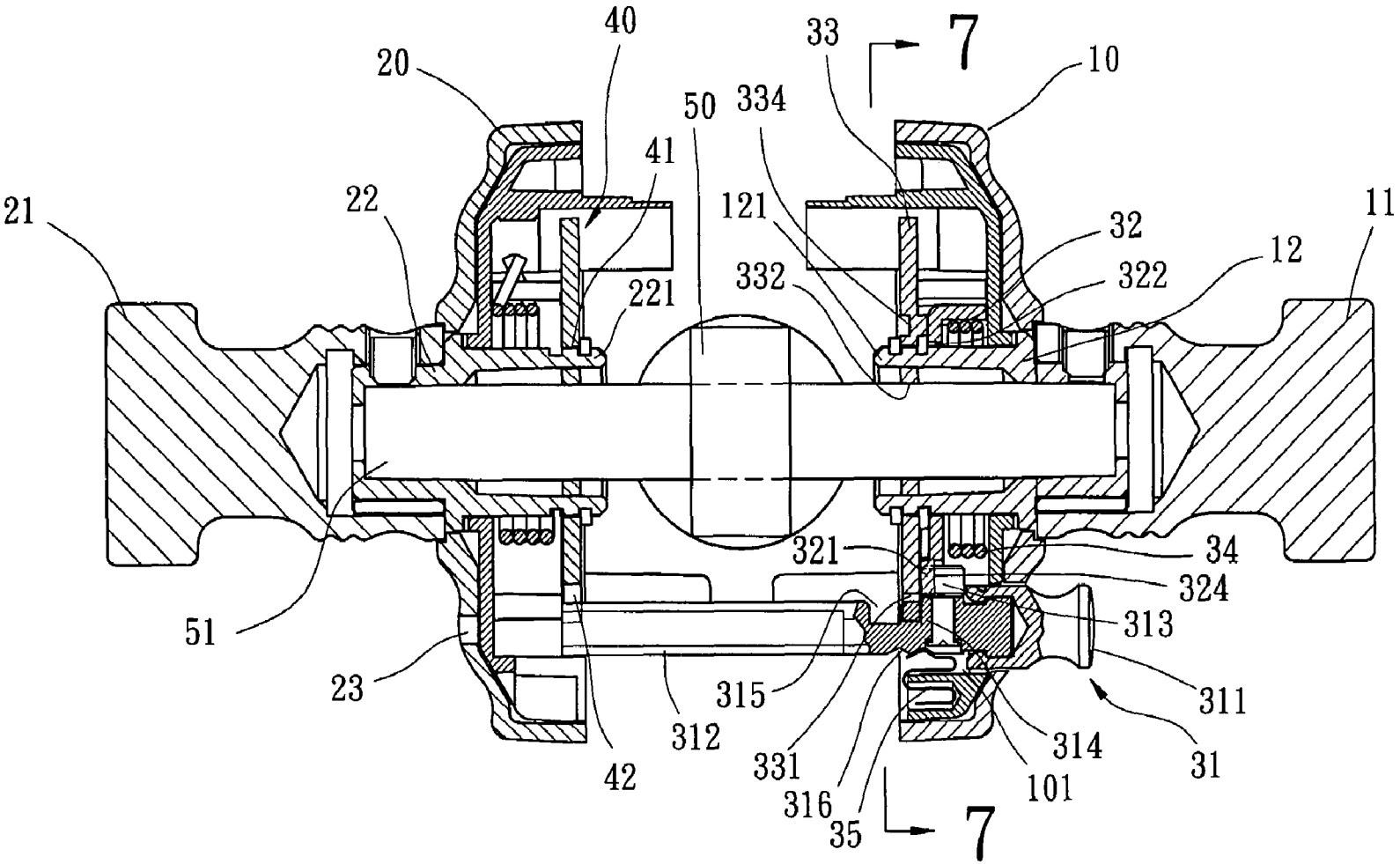
FIG. 6 is an assembled cross-sectional view of the bathroom lock device in accordance with the preferred embodiment of the present invention in a locked state.

Referring now to FIGS. 4 through 6, a bathroom lock device having an automatically unlocking structure in accordance with a preferred embodiment of the present invention is disclosed and may be installed on a door plank (not shown). In the preferred embodiment, the bathroom lock device generally includes an inner rose escutcheon designated numeral 10, an outer rose escutcheon designated numeral 20, an inner locking mechanism designated numeral 30, an outer actuating rotary plate designated numeral 40, a lock set designated. numeral 50 and an actuating shaft designated numeral 51. In the illustrated embodiment, the automatically unlocking structure in accordance with the present invention shall be only exemplified to apply to the inner locking mechanism 30 of the bathroom lock device. It will be understood that the automatically unlocking structure applied to another locking mechanism of another lock device, for instance, an outer locking mechanism, in accordance with the present invention will be omitted.

Still referring to FIGS. 4 and 6, constructions of the inner rose escutcheon 10 and the outer rose escutcheon 20 shall be described in detail. Typically, the inner rose escutcheon 10 includes an axial hole (not labeled) in place for rotatably receiving an inner spindle member 12. In the preferred embodiment, a first distal end of the inner spindle member 12 mechanically connects with an end of an inner lever 11 in the intended manner such that the inner lever 11 can turn the inner spindle member 12 in unlocking operation. Furthermore, a second distal end of the inner spindle member 12 forms with a pair of actuating walls 121 and a pair of notches 122, and any two adjacent ends of the actuating walls 121 define each of the notches 122. Similarly, the outer rose escutcheon 20 includes an axial hole (not labeled) in place for rotatably receiving an outer spindle member 22, as best shown in FIG. 6. In the preferred embodiment, a first distal end of the outer spindle member 22 mechanically connects with an end of an outer lever 21 in the intended manner such that the outer lever 21 can turn the outer spindle member 22. Furthermore, a second distal end of the outer spindle member 22 forms with a pair of actuating walls 221 and a pair of notches 222. The inner rose escutcheon 10 has an operating aperture 101 while the outer rose escutcheon 20 has a through hole 23.

Referring again to FIGS. 4 through 6, constructions of the inner locking mechanism 30, the outer actuating rotary plate 40 and the lock set 50 shall be described in detail. In the preferred embodiment, the inner locking mechanism 30 includes a manual control rod 31, an unlocking rotary plate 32, an inner actuating rotary plate 33, a spring member 34 and a limiting member 35 which are assembled to constitute a manually controllable mechanism for use in locking or unlocking the bathroom lock device. The above-described construction of the inner locking mechanism 30 will be described more fully below. The outer actuating rotary plate 40 includes a pair of curve holes 41 and a recessed portion 42, as best shown in FIG. 6. Each size of the curve holes 41 of the outer actuating rotary plate 40 is identical with each size of the corresponding actuating walls 221 of the outer spindle member 22 such that the outer spindle member 22 can synchronously turn the outer actuating rotary plate 40. The lock set 50 has a through hole (not labeled) through which to extend an actuating shalt 51. In operation, the actuating shaft 51 can drive a latch bolt (not labeled) to retract into or extend out of from the lock set 50 so as to permit control of opening or closing a door (not shown).

As will be discussed in greater detail subsequently, the manual control rod 31 of the inner locking mechanism 30 includes a pushing portion 311, a releasing rod portion 312, a rotatable wheel 313, a limiting portion 314, a free passageway 315 and a positioning groove 316 (as best shown in FIG. 6). When assembled, the pushing portion 311 extends beyond the operating aperture 101 of the inner rose escutcheon 10 so that the pushing portion 311 can be used to push at an inner side. The releasing rod portion 312 of the manual control rod 31 and the through hole 23 of the outer rose escutcheon 20 are in alignment each other, as best shown in FIG. 6. Consequently, a tool can extend through the through hole 23 of the outer rose escutcheon 20 at an outer side and push the releasing rod portion 312 of the manual control rod 31 for unlocking the bathroom lock device for the purpose of rescue.

Referring again to FIGS. 5 and 6, the rotatable wheel 313 of the manual control rod 31 in accordance with the preferred embodiment includes an axis (not labeled) which is extended downwardly from a bottom surface thereof. The axis of the rotatable wheel 313 is rotatably received in an assembling bore (not labeled) of the manual control rod 31 such that the rotatable wheel 313 can freely rotate about an axis of the assembling bore of the manual control rod 31. Formed on a distal end of the axis of the rotatable wheel 313 is an expanded portion which is engaged with the assembling bore of the manual control rod 31, as best shown in FIG. 6. Thereby, an unexpected disengagement of the rotatable wheel 313 from the manual control rod 31 is prevented. In initially assembling, the distal end of the axis of the rotatable wheel 313 extends beyond a bottom side of the assembling bore of the manual control rod 31. Subsequently, the distal end of the axis of the rotatable wheel 313 is punched to form the expanded portion by a pressing process and engaged with a periphery of the assembling bore of the manual control rod 31. Once engaged, a vertical movement of the axis of the rotatable wheel 313 along the axis of the assembling bore of the manual control rod 31 is limited. The limiting portion 314 is protruded from the manual control rod 31 and provided with inclined surfaces in aiding mechanical operations. In addition, the free passageway 315 is located beside a side of the limiting portion 314 adjacent to the releasing rod portion 312. The positioning groove 316 is formed on a bottom surface of the manual control rod 31, as best shown in FIG. 6.

Construction of the unlocking rotary plate 32 shall be described with reference to FIGS. 5 and 6. In the preferred embodiment, the unlocking rotary plate 32 includes a pair of actuating protrusions 321, a central opening 322 and a pair of engaging lugs 323. Each of the actuating protrusions 321 has an engaging surface 324 adapted to engage with the rotatable wheel 313 of the manual control rod 31. The engaging surfaces 324 of the actuating protrusions 321 are engaged with the rotatable wheel 313 of the manual control rod 31 if the manual control rod 31 is located at a locking position. Once the inner lever 11 is turned at the inner side, the actuating protrusions 321 of the unlocking rotary plate 32 push the manual control rod 31 to return to an unlocking position. Preferably, a distance formed between the two engaging surfaces 324 of the actuating protrusions 321 is slightly less than a diameter of the rotatable wheel 313 so that the actuating protrusions 321 are in perfect engagement with the rotatable wheel 313. By referring again to FIG. 6, the engaging surface 324 of the actuating protrusion 321 is preferably formed with a flat surface or a curved surface. Particularly, a convex curved surface of the actuating protrusion 321 ensures a good mechanical engagement with the rotatable wheel 313 in minimizing the chance of damaging inner components due to unwanted abrasion so as to carry out smoothly an unlocking operation. The actuating walls 121 of the inner spindle member 12 extend through the central opening 322 of the unlocking rotary plate 32 such that the engaging lugs 323 of the unlocking rotary plate 32 can be fitted within the notches 122 of the inner spindle member 12, respectively. To this end, the engaging lug 323 of the unlocking rotary plate 32 has a width identical with that of the notch 122 of the inner spindle member 12. Consequently, turning the inner spindle member 12 can synchronously rotate the unlocking rotary plate 32 without any delayed action.

Construction of the inner actuating rotary plate 33 shall be described with reference to FIGS. 4 and 6. In the preferred embodiment, the inner actuating rotary plate 33 includes a recession portion 331, a non-circular hole 332, a pair of curved holes 333 and a series of spaced-apart engaging protrusions 334. In locking operation, the limiting portion 314 of the manual control rod 31 can engage with the recession portion 331 of the inner actuating rotary plate 33, and limit any rotational movement of the inner actuating rotary plate 33. The actuating shaft 51 of the lock set 50 can extend through and engages in the non-circular hole 332 of the inner actuating rotary plate 33 such that the inner actuating rotary plate 33 and the lock set 50 are assembled by the actuating shaft 51. The actuating walls 121 of the inner spindle member 12 further extend through the curved holes 333 of the inner actuating rotary plate 33. Each size of the curved holes 333 of the inner actuating rotary plate 33 is greater than that of the corresponding actuating wall 121 of the inner spindle member 12 so that the inner actuating rotary plate 33 permits freely turning the spindle member 12 within a certain extent of the angular movement to create a delayed action of the bathroom lock device. However, the spindle member 12 can turn the inner actuating rotary plate 33 until the actuating walls 121 engage with peripheral edges of the curved holes 333. In order to minimize unwanted abrasion, the engaging protrusions 334 of the inner actuating rotary plate 33 engage with the unlocking rotary plate 32 to maintain a spaced relationship. In this way, the unlocking rotary plate 32 and the inner actuating rotary plate 33 are in perfect alignment with the rotatable wheel 313 and the limiting portion 314 of the manual control rod 31, respectively. The spring member 34 provides a spring action on the unlocking rotary plate 32 and the inner actuating rotary plate 33 to return to original positions after turning. Furthermore, mounted on the inner rose escutcheon 10 is the limiting member 35 as well as a resilient member which is employed to elastically engage in the positioning groove 316 of the manual control rod 31. Accordingly, this ensures a good positioning effect on the locking (or unlocking) position of the manual control rod 31.

Figure 7:
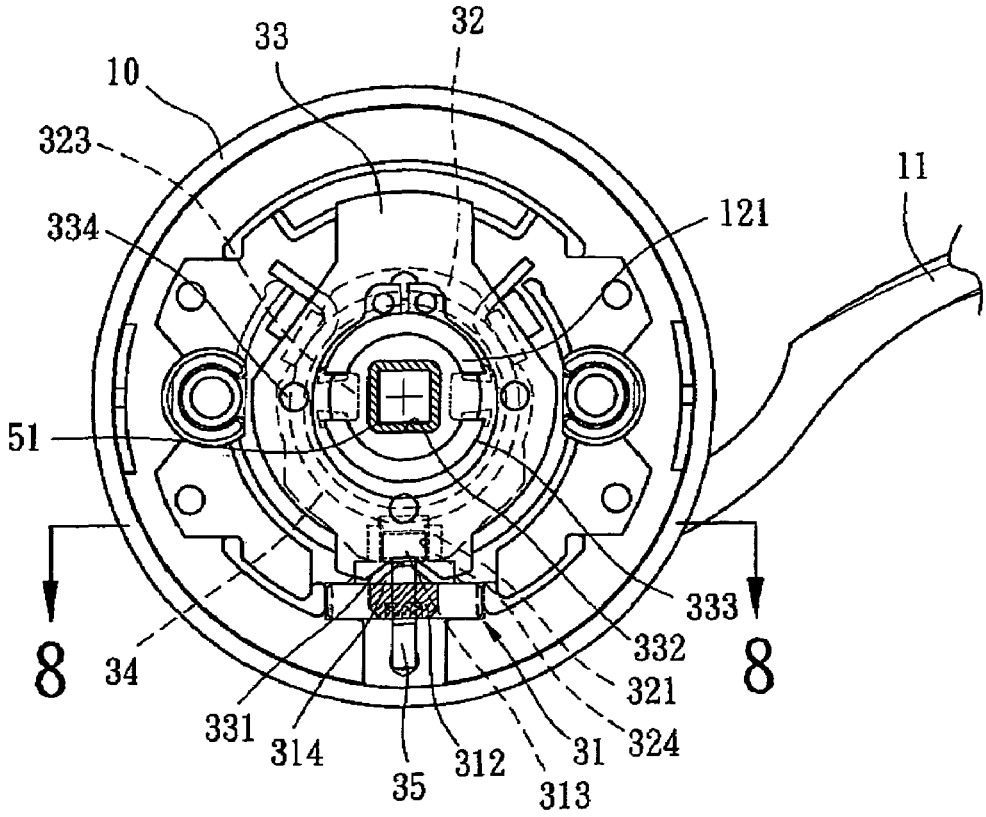
FIG. 7 is an assembled cross-sectional view, taken along line 7-7 in FIG. 6, of the bathroom lock device in accordance with the preferred embodiment of the present invention in the locked state.
Figure 8:
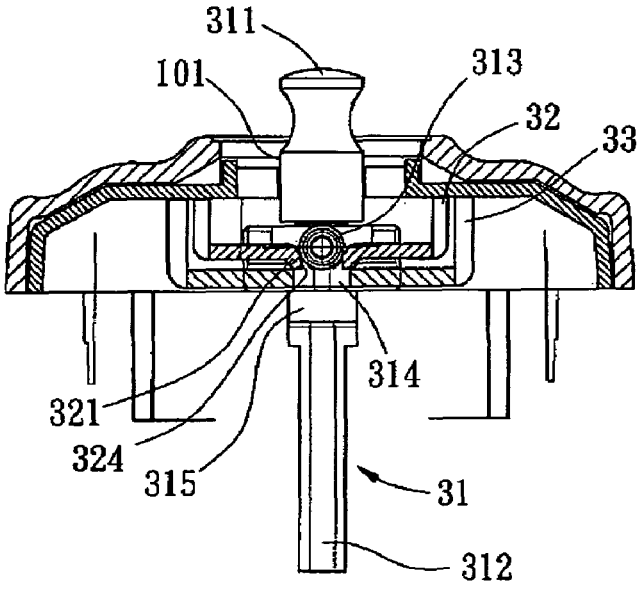
FIG. 8 is an assembled cross-sectional view, taken along line 8-8 in FIG. 7, of the bathroom lock device in accordance with the preferred embodiment of the present invention in the locked state.

FIGS. 6 through 8 illustrate the bathroom lock device in accordance with the preferred embodiment of the present invention in a locked state. In the preferred embodiment, the manual control rod 31 is pressed at the inner side in a direction outward the outer lever 21 so as to move a longitudinal distance and be positioned at the locking position. In the locked states the limiting portion 314 of the manual control rod 31 securely engages with the recession portion 331 of the inner actuating rotary plate 33 and limits any rotational movement of the inner actuating rotary plate 33. In addition, the actuating shall 51 successively extends through and engages with the inner actuating rotary plate 33, the lock set 50 and the outer locking mechanism 40. Under these conditions the manual control rod 31 of the inner locking mechanism 30 limits any turning movement of the lock set 50 and the outer locking mechanism 40, and even limits the outer lever 21 in addition to the inner actuating rotary plate 33. Furthermore, the releasing rod portion 312 of the manual control rod 31 is engaged with the recessed portion 42 of the outer actuating rotary plate 40 in the locking position.

Figure 9:
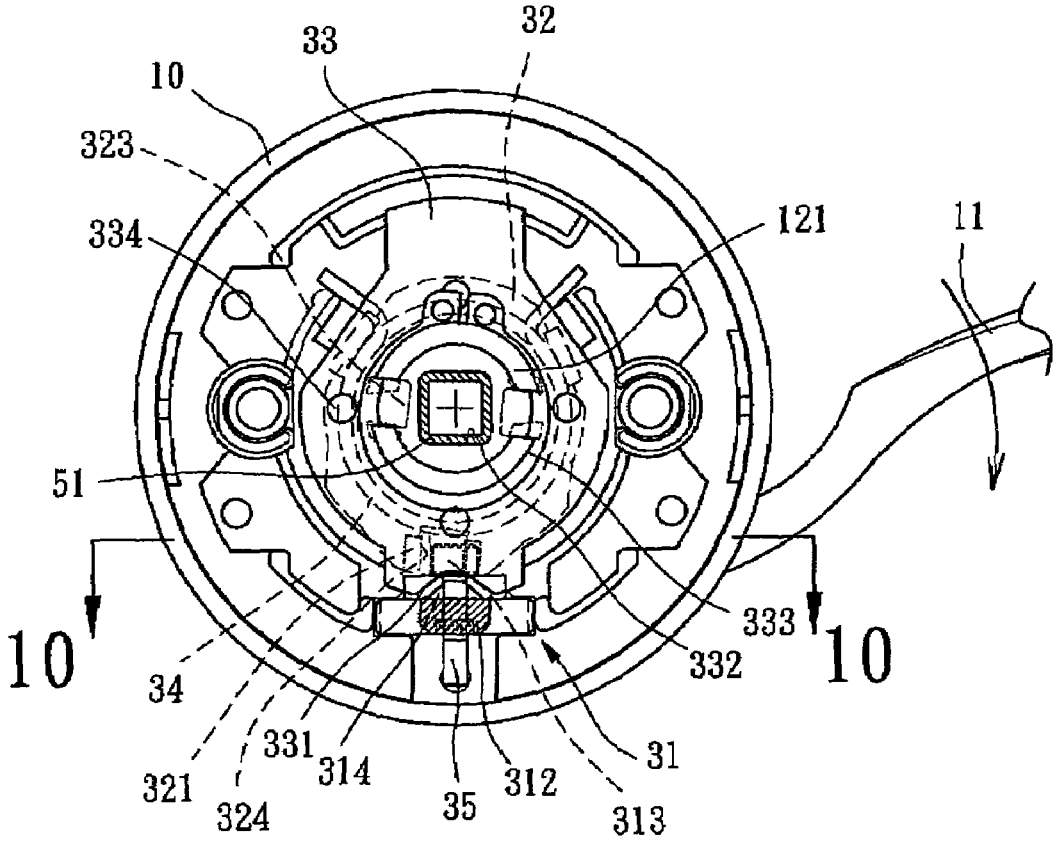
FIG. 9 is an assembled cross-sectional view of the bathroom lock device in accordance with the preferred embodiment of the present invention in the first instance of unlocking operation.
Figure 10:
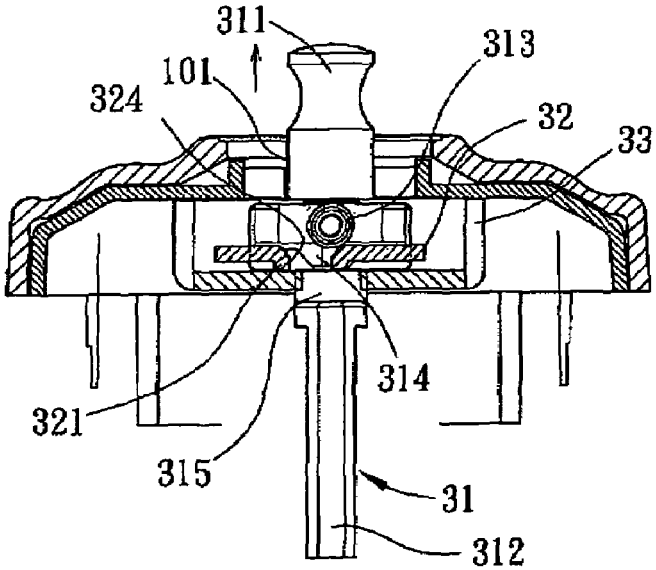
FIG. 10 is an assembled cross-sectional view, taken along line 10-10 in FIG. 9, of the bathroom lock device in accordance with the preferred embodiment of the present invention in unlocking operation.
Figure 11:
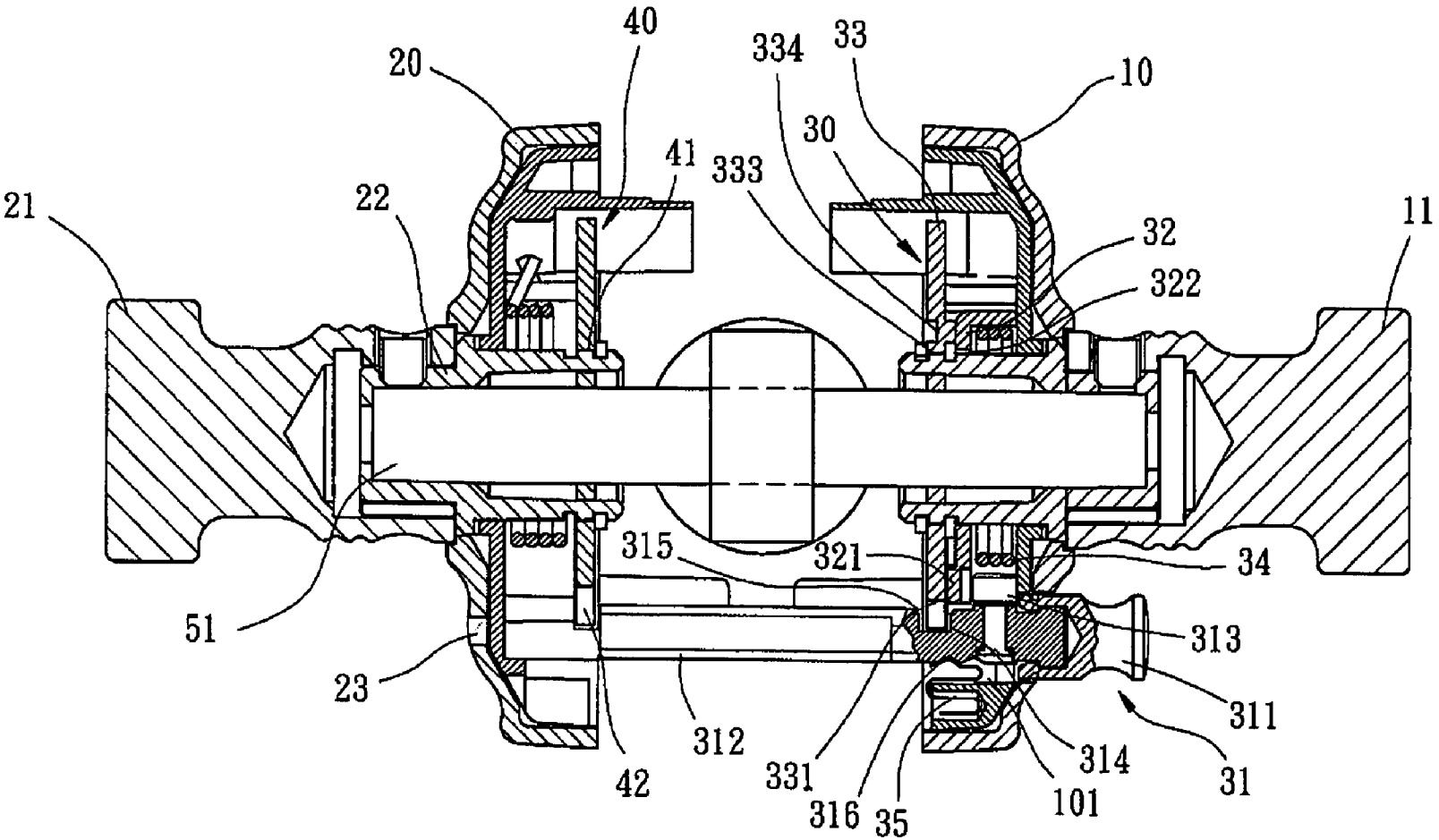
FIG. 11 is an assembled cross-sectional view of the bathroom lock device in accordance with the preferred embodiment of the present invention in a completely unlocked state.

Turning now to FIGS. 9 through 11, views of the bathroom lock device in accordance with the preferred embodiment of the present invention in unlocking operation are illustrated. In unlocking operation, the manual control rod 31 can be directly drawn out from the locking position to an unlocking position at the inner side for removing the locked state without turning the inner lever 11. In this way, the inner lever 11 can turn the inner actuating rotary plate 33 in the direction as indicated by the arrow in FIG. 9 for opening the bathroom door. Alternatively, turning the inner lever 11 can synchronously actuate the unlocking rotary plate 32 to turn a predetermined angle for removing the locked state. In this alternative way, one of the actuating protrusions 321 of the unlocking rotary plate 32 can push the rotatable wheel 313 of the manual control rod 31 to return to the unlocking position. When the inner lever 11 turns the inner spindle member 12, the actuating walls 121 of the inner spindle member 12 can synchronously turn the engaging lugs 323 of the unlocking rotary plate 32 but cannot actuate the curved holes 333 of the inner actuating rotary plate 33 within a certain extent of the angular movement for a delayed action. Subsequently, the actuating walls 121 of the inner spindle member 12 can engage with and turn the curved holes 333 of the inner actuating rotary plate 33 if the limiting portion 314 of the manual control rod 31 is disengaged from the recession portion 331 of the inner actuating rotary plate 33.

In unlocking operation, the actuating walls 121 of the inner spindle member 12 continuously turn the engaging lugs 323 of the unlocking rotary plate 32 so that one of the engaging surfaces 324 of the actuating protrusions 321 can smoothly push the rotatable wheel 313 of the manual control rod 31 to completely return to the unlocking position. In this way, the rotatable wheel 313 of the manual control rod 31 can travel along the engaging surface 324 of the unlocking rotary plate 32 and run on a side surface of the unlocking rotary plate 32, as best shown in FIG. 10. A pushing force of the engaging surface 324 of the unlocking rotary plate 32 applied to the rotatable wheel 313 can actuate the manual control rod 31 to move a longitudinal distance toward the inner lever 11 to return to the unlocking position, as best shown in FIG. 11.

The manual control rod 31 can be moved to return to the unlocking position if the actuating walls 121 of the inner spindle member 12 have actuated the unlocking rotary plate 32 to turn a predetermined angle. Subsequently, the actuating walls 121 of the inner spindle member 12 can engage with the peripheral edges of the curved holes 333 so as to turn the inner actuating rotary plate 33. Once returned, the limiting portion 314 of the manual control rod 31 is disengaged from the recession portion 331 of the inner actuating rotary plate 33 so that the inner actuating rotary plate 33 is in perfect alignment with the free passageway 315 of the manual control rod 31. This permits either of the inner lever 11 to turn the inner actuating rotary plate 33 or the outer lever 12 to turn the outer actuating rotary plate 40 for driving the latch bolt (not labeled) of the lock set 50 via the actuating shaft 51. In the preferred embodiment, the smooth unlocking operation can be achieved by the engaging surfaces 324 of the actuating protrusions 321 pushing and rotating the rotatable wheel 313 of the manual control rod 31 which can minimize operational abrasion.

Figure 1:
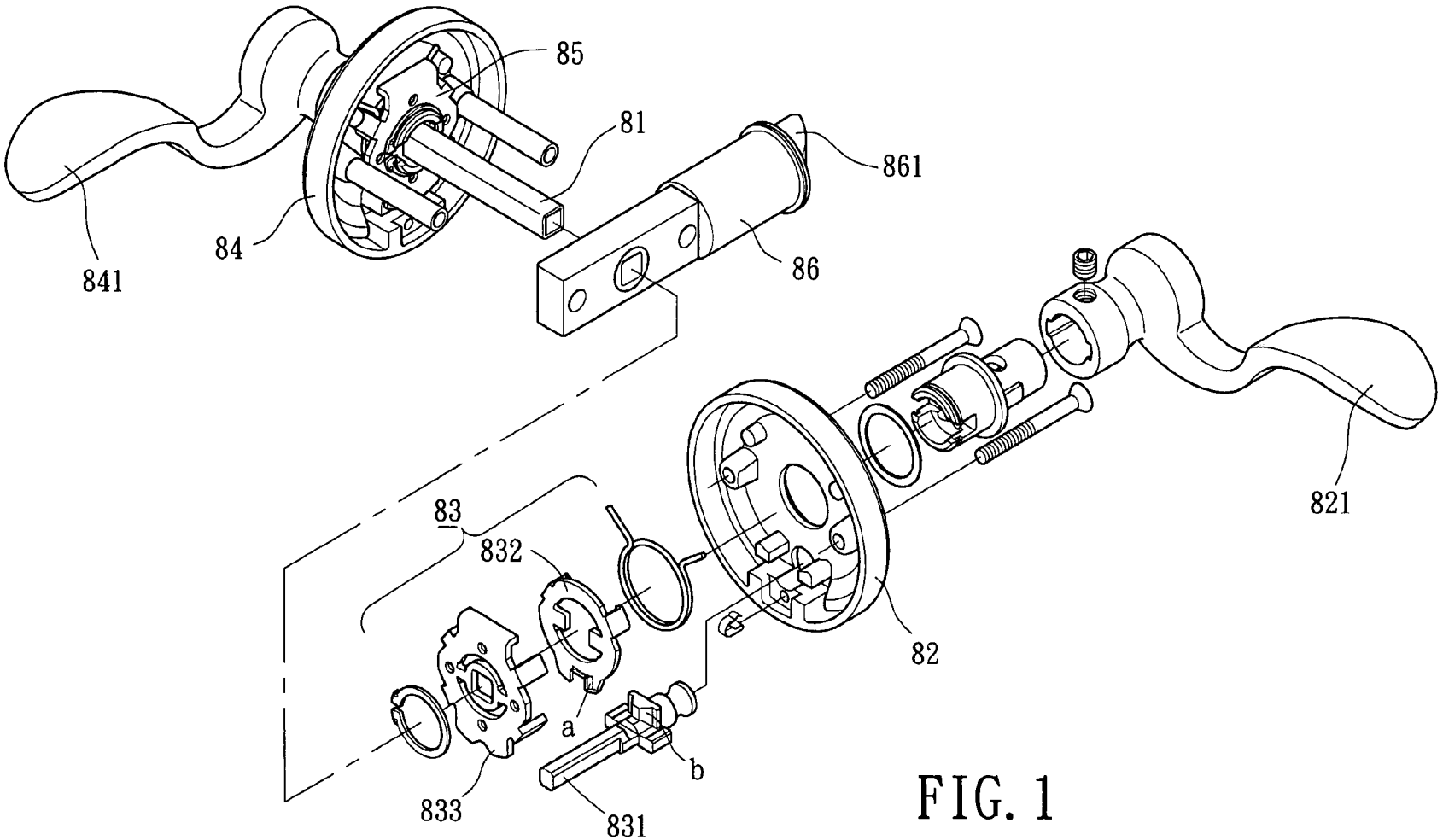
FIG. 1 PRIOR ART
FIG. 1 is an exploded perspective view of a bathroom lock device having an automatically unlocking structure in accordance with the prior art.
Figures 2, 3:
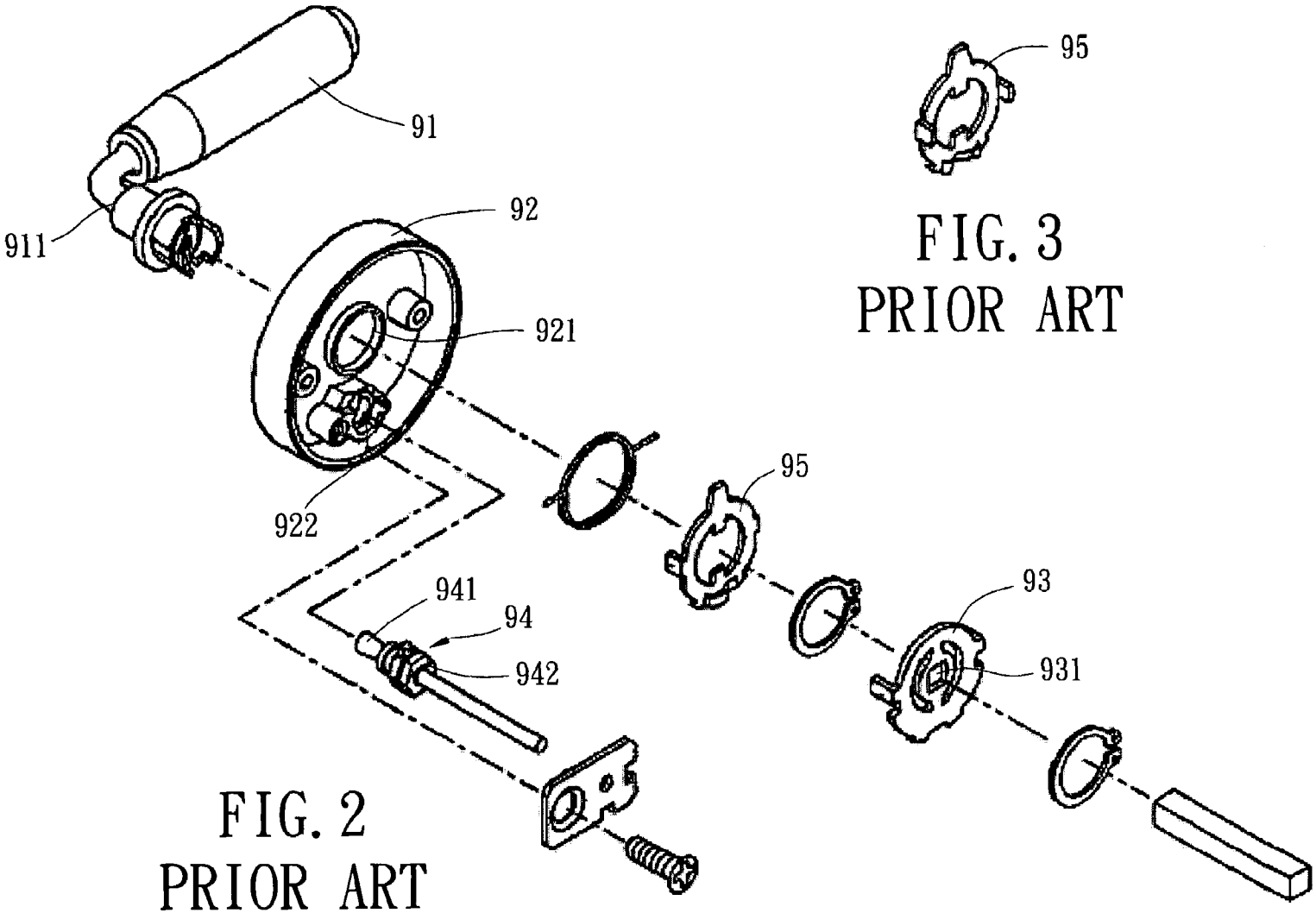
FIG. 3 PRIOR ART
FIG. 2 PRIOR ART
FIG. 2 is an exploded perspective view of another bathroom lock device having an automatically unlocking structure in accordance with the prior art.
FIG. 3 is a perspective view of an unlocking rotary plate for use in the automatically unlocking structure of the bathroom lock device, as depicted in FIG. 2, in accordance with the prior art.

It will be apparent from the aforementioned discussions that the conventional unlocking rotary plates 832 and 95 in FIGS. 1 and 2 are directly engaged with the manual control rods 831 and 94 and cause unwanted abrasion the manual control rods 831 and 94 in unlocking operation. Conversely, as best shown in FIG. 4, the engagement of the engaging surfaces 324 of the inner actuating rotary plate 33 with the rotatable wheel 313 of the manual control rod 31 in accordance with the present invention can minimize operational abrasion in unlocking operation and increase the useful life of the bathroom lock device.

Although the invention has been described in detail with reference to its presently preferred embodiment, it will be understood by one of ordinary skill in the art that various modifications can be made without departing from the spirit and the scope of the invention, as set forth in the appended claims.

What is claimed is:

1. A bathroom lock device having an automatically unlocking structure comprising:

an inner lever extending through an inner rose escutcheon;

an unlocking rotary plate connected with the inner lever;

an inner actuating rotary plate connected with the inner lever;

an actuating shaft connecting the inner actuating rotary plate with an outer actuating rotary plate, and the actuating shaft is adapted to actuate a lock set;

a manual control rod adapted to lock or unlock the bath room lock device; and a rotatable wheel arranged on the manual control rod to engage with the unlocking rotary plate;

wherein the manual control rod located at a locking position can limit a rotational movement of the inner actuating rotary plate to carry out a locked state; the unlocking rotary plate can push the rotatable wheel to return the manual control rod to an unlocking position;

wherein the rotatable wheel includes an axis rotatably received in an assembling bore of the manual control rod such that the rotatable wheel can freely rotate about an axis of the assembling bore of the manual control rod.

2. The bathroom lock device having the automatically unlocking structure as defined in claim 1, wherein a distal end of the axis of the rotatable wheel includes an expanded portion engaged with the assembling bore of the manual control rod.

3. The bathroom lock device having the automatically unlocking structure as defined in claim 1, wherein the unlocking rotary plate includes a pair of actuating protrusions each having an engaging surface to push the rotatable wheel of the manual control rod.

4. The bathroom lock device having the automatically unlocking structure as defined in claim 3, wherein a distance formed between the two engaging surfaces of the actuating protrusions is slightly less than a diameter of the rotatable wheel so that the actuating protrusions are in perfect engagement with the rotatable wheel.

5. The bathroom lock device having the automatically unlocking structure as defined in claim 3, wherein the engaging surface of the actuating protrusion is formed with a flat surface or a curved surface.

6. The bathroom lock device having the automatically unlocking structure as defined in claim 1, wherein the inner lever securely connects with the unlocking rotary plate and synchronously actuates the unlocking rotary plate.

7. The bathroom lock device having the automatically unlocking structure as defined in claim 1, wherein the inner lever connects with the inner actuating rotary plate, but the inner actuating rotary plate permits freely turning the inner lever within a predetermined angular movement to create a delayed action in an unlocking operation.

8. The bathroom lock device having the automatically unlocking structure as defined in claim 1, wherein the manual control rod has a limiting portion to engage with a recession portion of the inner actuating rotary plate in the locking position so that the actuating shaft, the outer actuating rotary plate and the outer lever cannot be turned.

9. The bathroom lock device having the automatically unlocking structure as defined in claim 1, wherein the manual control rod has a free passageway, when the manual control rod returns to the unlocking position, the inner actuating rotary plate is in perfect alignment with the free passageway.

10. The bathroom lock device having the automatically unlocking structure as defined in claim 1, wherein the manual control rod has a releasing rod portion aligned with a through hole of the outer rose escutcheon through which to extend a tool to push the releasing rod portion for unlocking the bathroom lock device.

11. The bathroom lock device having the automatically unlocking structure as defined in claim 10, wherein the releasing rod portion of the manual control rod is engaged with a recessed portion of the outer actuating rotary plate in the locking position.

12. The bathroom lock device having the automatically unlocking structure as defined in claim 1, wherein the manual control rod has a positioning groove to engage with a limiting member mounted on the inner rose escutcheon so as to position the manual control rod either at the locking position or the unlocking position.

13. The bathroom lock device having the automatically unlocking structure as defined in claim 1, wherein the inner lever further connects with an inner spindle member which has a pair of actuating walls and a pair of notches.

14. The bathroom lock device having the automatically unlocking structure as defined in claim 13, wherein the unlocking rotary plate includes a pair of engaging lugs securely engaged with the actuating walls of the inner spindle member, respectively.

15. The bathroom lock device having the automatically unlocking structure as defined in claim 13, wherein the actuating walls of the inner spindle member further extend through curved holes of the inner actuating rotary plate which permit freely turning the spindle member within a certain extent of the angular movement.

16. A bathroom lock device having an automatically unlocking structure comprising:

an inner lever extending through an inner rose escutcheon;

an unlocking rotary plate connected with the inner lever;

an inner actuating rotary plate connected with the inner lever;

an actuating shaft connecting the inner actuating rotary plate with an outer actuating rotary plate, and the actuating shaft is adapted to actuate a lock set;

a manual control rod adapted to lock or unlock the bath room lock device; and a rotatable wheel arranged on the manual control rod to engage with the unlocking rotary plate;

wherein the manual control rod located at a locking position can limit a rotational movement of the inner actuating rotary plate to carry out a locked state; the unlocking rotary plate can push the rotatable wheel to return the manual control rod to an unlocking position;

wherein the unlocking rotary plate includes a pair of actuating protrusions each having an engaging surface to push the rotatable wheel of the manual control rod;

wherein the engaging surface of the actuating protrusion is constructed from a convex curved surface so as to minimize abrasion on the rotatable wheel of the manual control rod.

17. The bathroom lock device having the automatically unlocking structure as defined in claim 16, wherein a distance formed between the two engaging surfaces of the actuating protrusions is slightly less than a diameter of the rotatable wheel so that the actuating protrusions are in perfect engagement with the rotatable wheel.

18. The bathroom lock device having the automatically unlocking structure as defined in claim 16, wherein the engaging surface of the actuating protrusion is formed with a flat surface or a curved surface.

19. The bathroom lock device having the automatically unlocking structure as defined in claim 6, wherein the inner lever securely connects with the unlocking rotary plate and synchronously actuates the unlocking rotary plate.

20. The bathroom lock device having the automatically unlocking structure as defined in claim 16, wherein the inner lever connects with the inner actuating rotary plate, but the inner actuating rotary plate permits freely turning the inner lever within a predetermined angular movement to create a delayed action in an unlocking operation.

* * * * *